United States Patent [19]

Hopkins et al.

[11] 4,018,012

[45] Apr. 19, 1977

[54] METHOD OF GRINDING METAL BILLETS, BLOOMS OR SLABS

[75] Inventors: Richard G. Hopkins, Bennington Township, Shiawassee County, Mich.; Paul E. Stockhausen, Canfield, Ohio

[73] Assignee: MWA Company, Owosso, Mich.

[22] Filed: Mar. 7, 1975

[21] Appl. No.: 556,398

Related U.S. Application Data

[63] Continuation-in-part of Ser. No. 405,298, Oct. 11, 1973, Pat. No. 3,874,123.

[52] U.S. Cl. ..... 51/281 R

[51] Int. Cl.[2] ..... B24B 1/00

[58] Field of Search ..... 51/109 R, 119–121, 51/281 R, 56, 122

[56] References Cited

UNITED STATES PATENTS

| | | | |
|---|---|---|---|
| 571,564 | 11/1896 | Hoffman | 51/120 |
| 1,833,359 | 11/1931 | Fox | 51/56 |
| 2,033,034 | 3/1936 | Knaff | 51/120 |
| 2,070,944 | 2/1937 | Hillix | 51/120 X |
| 3,353,305 | 11/1967 | Wolk | 51/122 |
| 3,593,465 | 7/1971 | Krippes | 51/120 |

*Primary Examiner*—Al Lawrence Smith
*Assistant Examiner*—Nicholas P. Godici
*Attorney, Agent, or Firm*—Whittemore, Hulbert & Belknap

[57] ABSTRACT

A method of grinding a metal billet by supporting a group of grinding wheels in a circular array above the slab, bloom or billet, rotating the grinding wheels individually, and orbiting the grinding wheels about a central axis extending transversely of the workpiece. The workpiece is moved back and forth under the grinding wheels and the grinding wheels are preferably tilted one way and then the other as the workpiece moves back and forth so that the wheels will grind at a negative rake. The grinding wheels are supported in a manner such that they can float and thus follow the contour of the material being ground.

2 Claims, 4 Drawing Figures

AA
VV
CC
DD
MM
BB
W
P
130

METHOD OF GRINDING METAL BILLETS, BLOOMS OR SLABS

REFERENCE TO RELATED APPLICATION

This application is a continuation-in-part of our copending application Ser. No. 405,298, filed Oct. 11, 1973 and now U.S. Pat. No. 3,874,123.

BACKGROUND AND SUMMARY OF THE INVENTION

Conventional grinders for scaling steel slabs and billets have a single grinding wheel mounted on the end of a boom or arm. The wheel grinds on its periphery and removes metal along a narrow path from a workpiece when the wheel is moved relative to the workpiece or vice versa. The wheel is indexed in a transverse direction as the workpiece or wheel moves back and forth to grind the entire surface of the billet or slab. This procedure is very time consuming because the wheel grinds on such a narrow path.

In accordance with this invention, multiple grinding wheels are employed. The wheels are orbited as the work and wheels move relative to one another so that the wheels grind a relatively wide path. Accordingly, much less time is required to grind the entire surface of the billet, bloom or slab than heretofore.

Figure 1:
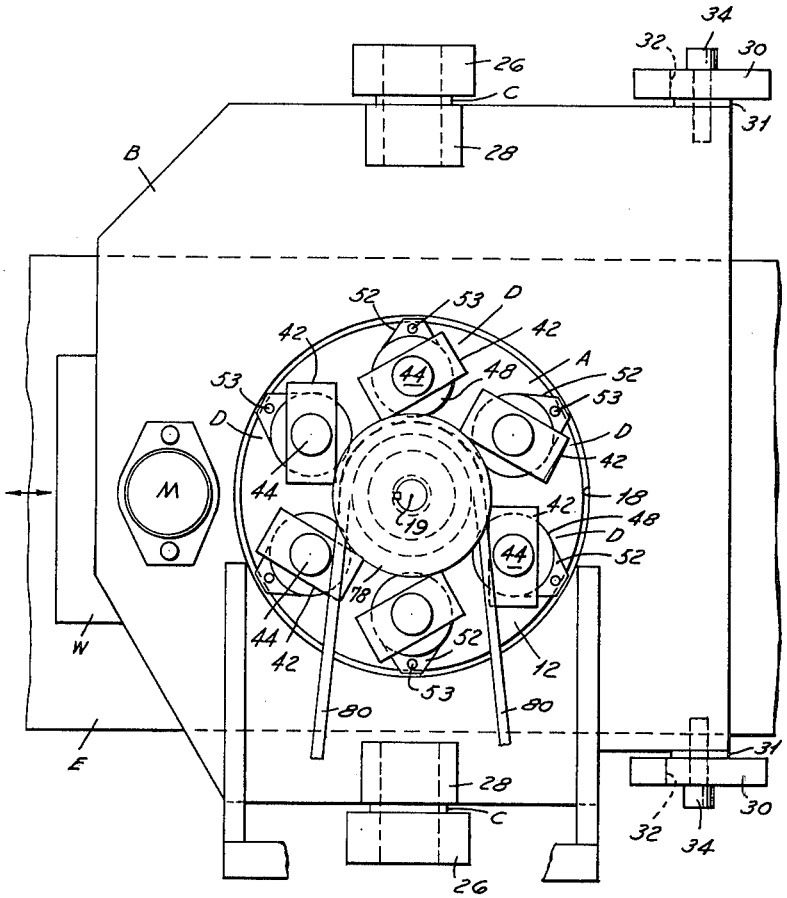
FIG. 1 is a top plan view of grinding apparatus suitable for carrying out the method of our invention.
Figure 2:
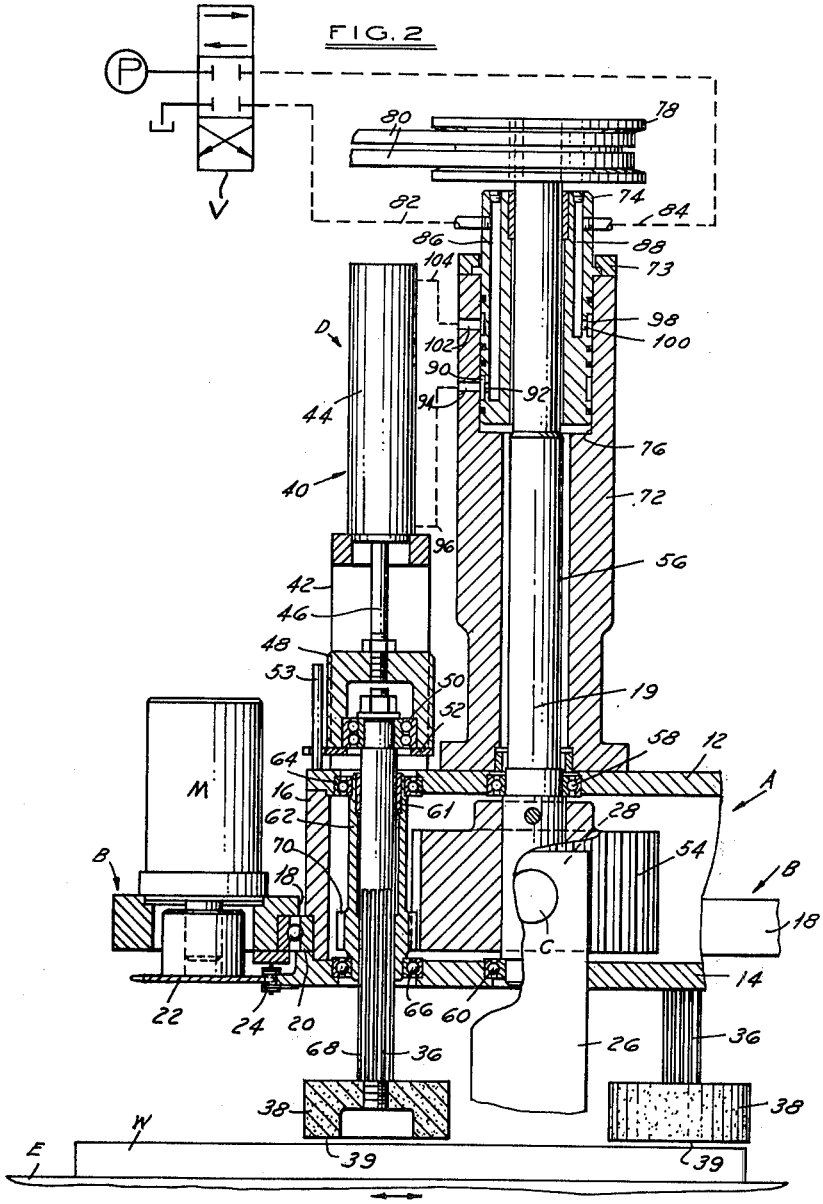
FIG. 2 is a fragmentary vertical sectional view of the apparatus shown in FIG. 1.

Referring now to the drawings and more particularly to FIGS. 1 and 2, the grinding apparatus comprises a head or drum A mounted for rotation on a base B which is supported for tilting movement about the horizontal axis of aligned pivots C. A plurality of grinder units D are mounted on the drum or head in a circle concentric with the axis of rotation of the drum to abrade and remove scale from the top horizontal surface of a steel slab, bloom or billet W which may be moved back and forth beneath grinder units D on a horizontally movable carriage E. Alternatively, the slab, bloom or billet W may remain stationary and the grinding apparatus may be moved over the work.

The drum of head A is a hollow member having circular top and bottom plates 12 and 14 marginally connected by the cylindrical wall 16. The base B has a circular hole 18. The drum A is supported in the hole 18 of the base for rotation about its central axis 19 by the bearing 20. A motor M mounted on the base B has a sprocket 22 in driving engagement with an annular chain 24 secured to the margin of the bottom plate 14 of the head so that the head is rotated by the motor.

The base B is supported for tilting movement about the horizontal axis of the aligned pivot pins C. Such pivot pins are carried by the upper ends of the uprights 26 and are supported in bearing blocks 28 mounted on the base B. Any suitable means may be provided for locking the base B in a given angular position such for example as the uprights 30 having the arcuate slots 32 through which extend the bolts 34 threaded into the edges of the base B. The same locking mechanism is shown in side elevation in the embodiment shown in FIG. 4 and it will be understood that when the bolts 34 are tightened the base B is locked in a given angular position by being clamped to the uprights 30. Friction pads 31 may be provided between the uprights 30 and the base. FIG. 2 shows the base B, and hence the drum A, locked in a horizontal position so that the drum axis 19 is perpendicular to the top surface of the work to be ground, but often during grinding the base will be supported at an angle to the horizontal so that the grinding wheels may grind at a negative rake as hereinafter more fully described. The base B may be power-tilted one direction and then the other from horizontal depending on the direction of relative movement of the wheels and the work by power means which may be of the type shown at 300 in FIG. 4.

Grinder units D are arranged in spaced relation to one another in a circle the center of which coincides with the axis of rotation 19 of drum A. The several grinder units are identical so that a description of one will suffice for all. Spacing of wheel centers and wheel size determines the width of the path that can be ground. Means can also be provided to vary the centers of the wheels, if desired.

Each grinder unit D comprises a spindle 36 parallel to drum axis 19 and having a grinding element 38 secured to the lower end. The grinding element 38 in this instance is a circular abrasive member or disc adapted to grind or abrade on its bottom surface 39, which is normal to the axis of spindle 36. The grinding element may take other forms obviously and could for example be of the segmented type. Each grinder unit also includes a fluid piston cylinder assembly 40 which is supported on the top plate 12 of the drum by a bracket 42. The cylinder 44 of the piston cylinder assembly 40 is parallel to drum axis 19 and has a piston, not shown, therein. A rod 46 extends from the piston downwardly through the bottom of the cylinder and has a hollow coupling 48 secured to the lower end. A bearing 50 is held within the hollow coupling by a retainer plate 52. The upper end of the spindle 36 is rotatably supported in the bearing 50. A pin 53 projecting upwardly from drum A extends through a hole in retainer plate 52 to prevent the retainer plate and coupling 48 from rotating but permitting sliding movement thereof.

The spindle 36 is driven by a gear 54 within the drum A secured to the lower end of an upright shaft 56 which lies on the axis of rotation 19 of the drum and is rotatably supported by bearings 58 and 60 in the top and bottom plates 12 and 14 of the drum. Each spindle is axially slidably supported by a bushing 61 in a sleeve 62 which is supported for rotation by bearings 64 and 66 in the top and bottom plates of the drum. The lower portion 68 of each spindle is splined and has a spline connection with the sleeve 62 so as to rotate with the sleeve but be capable of axial movement relative thereto. The sleeve has an integral gear 70 meshing with the gear 54 so as to be driven thereby. The shaft 56 is enclosed within an elongated tubular member 72 secured to and projecting upwardly from the top plate 12 of the drum. A sleeve 74 has a rotatable fit in the enlarged socket 76 in the upper end portion of the tubular member 72 and rotatably supports the upper end of shaft 56. Sleeve 74 is held in tubular member 72 by ring 73. The shaft 56 is driven by a suitable source of power, not shown, in driving connection with a pulley 78 on the upper end of the shaft by belts 80.

It will be understood that all of the other spindles of the grinder units D are likewise driven in rotation by being geared to the gear 54 in the manner shown in FIG. 2.

Each cylinder 44 is supplied with fluid to raise and lower its piston and hence the grinding element 38 by fluid supplied from a common source P. The source P leads to a four-way three-position valve V having conduits 82 and 84 leading to the drilled passages 86 and 88 in the sleeve 74. Passage 86 communicates with an annular groove 90 in the sleeve by way of ports 92, and the annular groove 90 is in communication with a passage 94 in tubular member 72 leading to the conduit 96 to one end of the cylinder. The other drilled passage 88 in sleeve 74 leads to an annular groove 98 in sleeve 74 by way of ports 100, and the groove 98 communicates through passage 102 in tubular member 72 with conduit 104 leading to the opposite end of the cylinder. The cylinders of the other grinder units are connected into the grooves 90 and 98 by other passages similar to passages 94 and 102. It will be apparent that valve V in one position will direct fluid to the lower end of the cylinders while exhausting the upper end to raise the grinding elements away from the work, in a second position will direct fluid to the upper end of the cylinders while exhausting the lower end to force the grinding elements downward into pressure engagement with the work W on carriage E, and in a third position will seal the lines 82 and 84 to lock the pistons within cylinders 44 and hence hold the grinding wheels in any given positions with respect to the work.

In the practice of the method of our invention using the apparatus of FIGS. 1 and 2, the carriage E is moved back and forth in the direction of the arrows. the motor M is operated to rotate the drum A and accordingly orbit the grinding elements 38. The gear 54 is rotated to turn all of the grinding elements on their individual axes. The grinding elements, with valve V in a position to direct pressure fluid to the upper end of the cylinders 44, are forced downward into contact with the work under a yielding pressure. As seen in FIG. 1, the orbiting grinding elements have a wide sweep or path which in this instance is slightly greater than the width of the workpiece W to grind the entire upper surface of the workpiece on one pass. The grinding elements are under a yielding pressure depending upon the pressure of the hydraulic fluid supplied from the source P and are therefore individually floatable so as to follow the contour of the work. It is apparent that a single pass is all that is necessary to grind the entire upper surface of the work. However, additional passes may be made to remove more metal and this is accomplished by reversing the workpiece at each end of its travel and continuing to move it back and forth as many times as necessary.

The supporting base B and drum A are shown disposed horizontally in FIG. 2 so that the grinding faces 39 of the grinding elements 38 press flush upon the surface of the work being ground. It is often preferred to grind with a slight negative rake, that is on the trailing edges of the grinding elements, and to accomplish this the bolts 34 may be loosened to tip the base B away from the horizontal and then tightened to lock the base in tipped position. As above stated, the base B may be power-tilted one way and then the other to achieve a negative rake as the work moves back and forth, by power means such as shown at 300 in FIG. 4.

The valve V may be shifted to direct pressure fluid to the lower end of the cylinders 44 to raise the grinding elements from the work.

Figure 3:
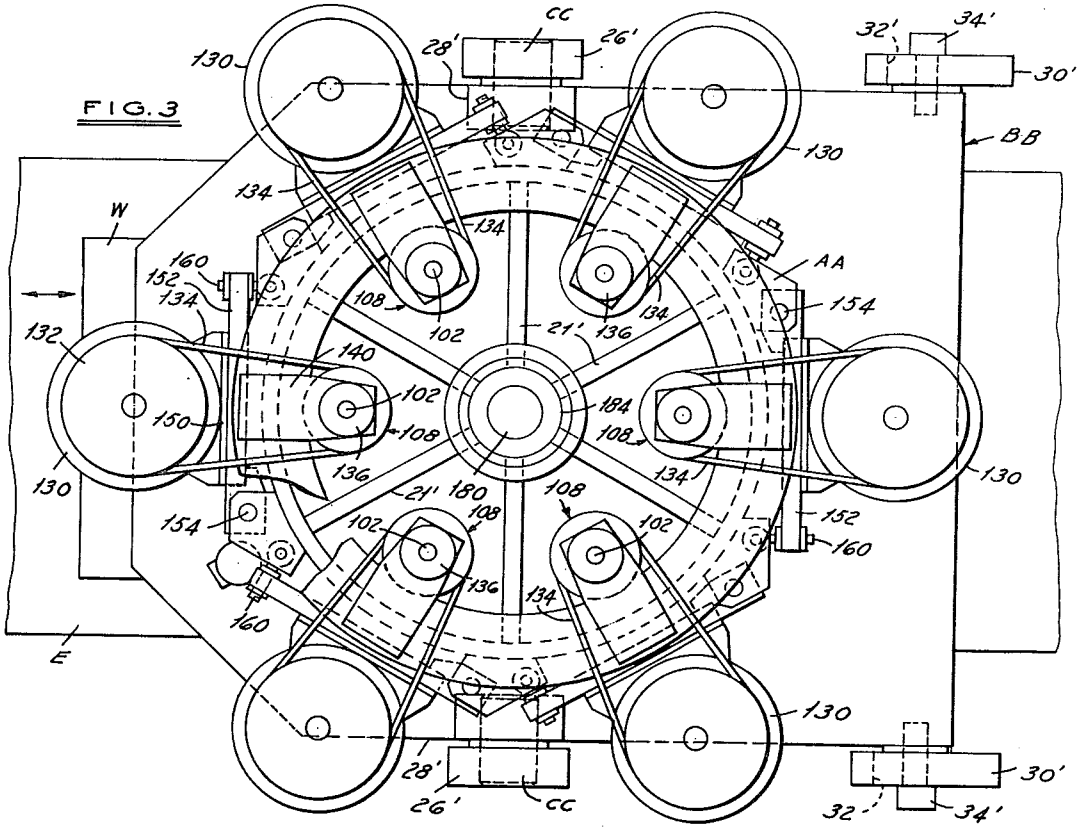
FIG. 3 is a top plan view of grinding apparatus having a modified construction, also suitable for carrying out the method of our invention.
Figure 4:
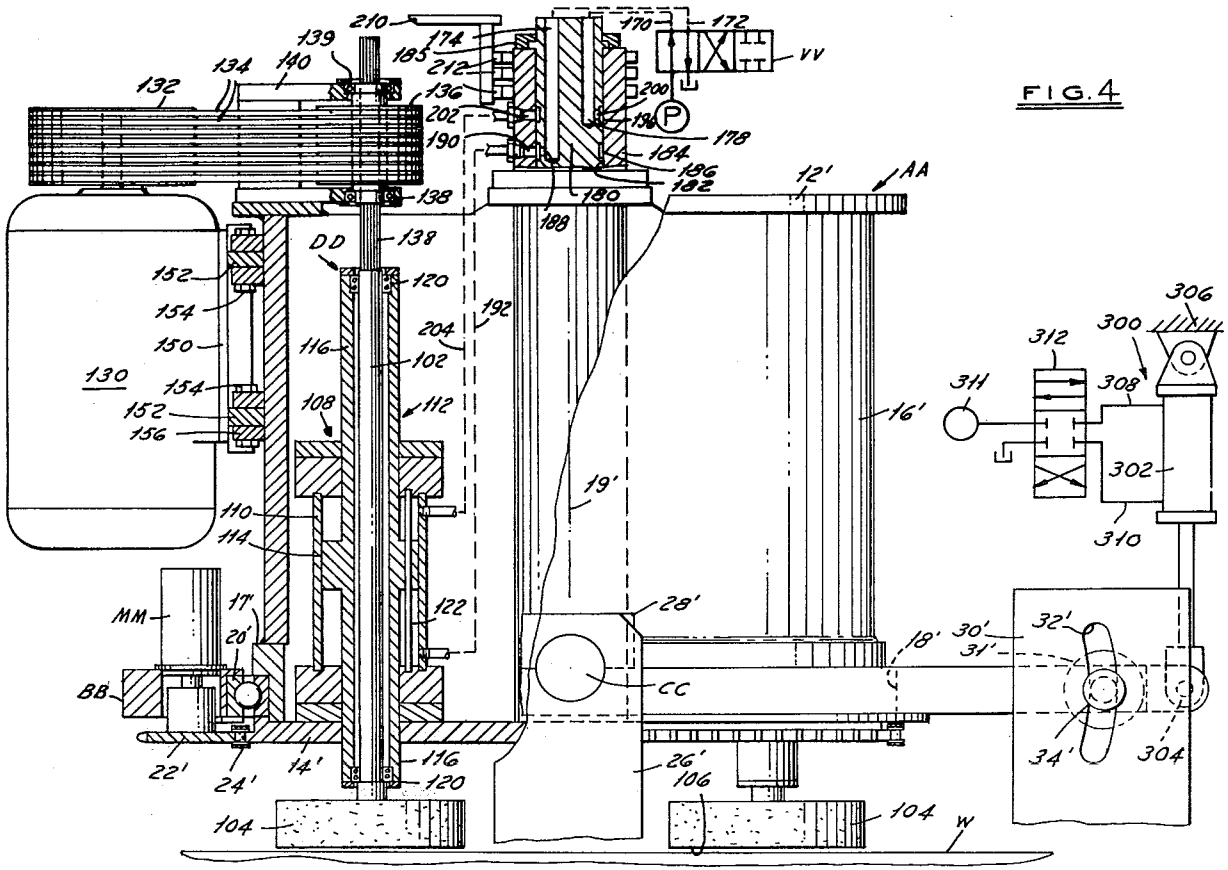
FIG. 4 is a side elevational view with parts in section of the modified construction of FIG. 3, one of the grinder units being shown in detail, a portion of another being shown but the others being omitted for clarity.

FIGS. 3 and 4 illustrate a modified construction which differs from the embodiment of FIGS. 1 and 2 essentially in that separate power sources are provided for rotating the spindles of the several grinder units. The grinding apparatus comprises a head or drum AA mounted for rotation on a base BB which is supported for tilting movement about the horizontal axis of aligned pivots CC. A plurality of grinder units DD are mounted on the drum or head in a circle concentric with the axis of rotation of the drum.

The drum or head AA is hollow and has a circular top ring 12' and a bottom plate 14' marginally connected by the cylindrical wall 16' and ring 17'. Radial ribs 21' divide the interior space of the drum into segments as shown in FIG. 3 for the grinder units DD. The base has a circular hole 18'. The drum AA is supported in the hole 18' of the base for rotation about its central axis 19' by the bearing 20'. A motor MM mounted on the base BB has a sprocket 22' in driving engagement with an annular chain 24' secured to the margin of the bottom plate 14' so that the head is rotated by the motor MM.

The base is supported for tilting movement about the horizontal axis of the aligned pivot pins CC. Such pivot pins are carried by the upper ends of the uprights 26' and are supported in bearing blocks 28' mounted on the base BB. Any suitable means may be provided for locking the base BB in a given angular position such as the uprights 30' having the arcuate slots 32' through which extend the bolts 34' threaded into the edges of the base BB. The bolts when tightened lock the base BB in a given angular position by clamping it to the uprights 30'. Friction pads 31' may be interposed between the uprights and the base. The base BB may be power tilted one way and then the other depending on the direction of relative movement of the wheel and the work by power means 300 which may comprise a fluid cylinder 302 having a piston (not shown) pivoted as at 304 to base BB. The cylinder is pivoted to a fixed support 306 and fluid under pressure is delivered from pump 311 to either end of the cylinder and exhausted from the other end by fluid lines 308 and 310 depending upon the position of the four-way three-position valve 312. In one position of valve 312, fluid is directed to the upper end of the cylinder while the lower end is exhausted, in a second position fluid is directed to the lower end of the cylinder while the upper end is exhausted, and in a third position fluid lines 308 and 310 are sealed to lock the base BB in a given position.

The grinder units DD as in the first embodiment are arranged in spaced relation to one another in a circle, the center of which coincides with the axis of rotation 19' of the drum AA. Spacing of wheel centers and wheel size determines the width of the path that can be ground, and as in FIG. 1, means may be provided to vary the centers of the wheels as desired. Such grinder units DD are identical and each comprises a spindle 102 having a grinding element 104 secured to the lower end. The grinding element 102 in this instance is a circular abrasive member or disc adapted to grind or abrade on its bottom surface 106. The grinding elements may as in the first embodiment described take other forms as for example may be of the segmented type. Each grinder unit DD also includes a fluid piston cylinder assembly 108 which is supported on the bottom plate 14' of the drum. The cylinder 110 of the piston-cylinder assembly is parallel to drum axis 19'. An elongated tubular plunger 112 is axially slidably mounted in the cylinder. Such plunger has a piston 114 within the cylinder and integral extensions or rod ends 116 which extend above and below the piston through the opposite ends of the cylinder. The spindle 102 extends coaxially through the plunger and is mounted therein for free rotation but constrained to move axially therewith by bearings 120. A pin 122 extending axially within the cylinder passes through a hole in the piston 114 to prevent the piston from rotating but permitting it to slide axially within the cylinder.

Each spindle 102 is individually driven by a motor 130 having an output pulley 132. Belts 134 extend around the pulley 132 and around a pulley 136 on the upper end portion of the spindle 102. The upper end portion of the spindle, designated 138, is splined and has a spline connection with pulley 136 so that it may slide axially within the pulley but is constrained to rotate therewith. The pulley 136 is supported in bearings 139 held by a bracket 140 mounted on the top ring 12' of the drum AA. Each motor 130 is supported on the drum by a mounting 150 having horizontal arms 152 which are pivoted at one end by pins 154 to a supporting bracket 156 on the drum. The opposite end of each arm is connected to a pin 160 pivoted to a mounting bracket 156. The pin 160 has an adjustable threaded connection with the arm 152 to permit adjustment of the tension on the driving belts 134.

Each of the cylinders 110 is supplied with fluid to raise and lower its piston and hence the grinding element 104 by fluid supplied from a common source P. The source P leads to a four-way three-position valve VV having conduits 170 and 172 leading to the drilled passages 174 and 178 in the sleeve 180. Sleeve 180 has a rotatable fit in a socket 182 in the upper end portion of an elongated tubular member 184 which is secured to and projects upwardly from the top plate 12' of the drum in coaxial relation with the drum. The sleeve 180 is held in the socket by ring 185.

Passage 174 communicates with an annular groove 186 in the sleeve by ports 188, and the annular groove is in communication with a passage 190 in tubular member 184 leading to the conduits 192 to the lower ends of cylinders 110. The other drilled passage 178 in sleeve 180 leads to an annular groove 196 in sleeve 180 by way of ports 200, and the groove 196 communicates through passage 202 in tubular member 184 with conduits 204 leading to the upper ends of the cylinders 110. The cylinders of the other grinder units are connected with the grooves 186 and 196 by other passages similar to passages 190 and 202. It will be apparent that the valve VV in one position will direct fluid to the lower end of the cylinders while exhausting the upper end to raise the grinding elements away from the work, in a second position will direct fluid to the upper end of the cylinders while exhausting the lower end to force the grinding elements downward into pressure engagement with the work W on carriage E, and in a third position will seal lines 170 and 172 to lock the pistons 114 of cylinders 110 and hence hold the grinding wheels 104 in given positions with respect to the work.

Any suitable means may be provided for transmitting electrical energy to the motors 130. In the present instance, it is brought in by wiring through conduit 210 and by commutator rings 212 is supplied to the tubular member 184 which turns with the drum AA. Since the motors 130 are also mounted on and turn with the drum AA, wiring from the commutator rings on the tubular member 184 may be connected directly to the several motors.

The practice of the method of our invention using the apparatus shown in FIGS. 3 and 4 is substantially the same as with the apparatus shown in FIGS. 1 and 2. The motor MM rotates the drum AA to orbit the grinding elements 104. Each of the grinding elements is individually rotated on its own axis by its own motor 130. When valve VV is in the illustrated position, the grinding elements are forced downward into contact with the work under pressure by hydraulic fluid delivered to the upper ends of the cylinders 110. The grinding elements are under a yielding pressure depending upon the pressure of the hydraulic fluid supplied from the source P and can individually follow the contour of the work.

As with the embodiment of FIGS. 1 and 2, the supporting base BB and drum AA may be disposed horizontally so that the grinding faces of the rotary grinding elements press flush or flat upon the surface of the work or they may be locked in a tilted position to grind with a negative rake if desired. The power means 300 is used to tilt the base and to reverse the tilt when necessary.

The valve VV when shifted from the position shown to its other position will direct fluid to the lower end of the cylinders and exhaust ends to raise the grinding elements away from the work.

We claim:

1. A method of removing metal from the surface of a metal workpiece such as a steel slab, bloom or billet, comprising supporting a plurality of grinding wheels in spaced relation about an axis extending transversely of said surface, holding said grinding wheels in contact with said surface under a yielding pressure so that each grinding wheel can follow the contour of said surface independently of the others, rotating said grinding wheels about their own axes, orbiting said grinding wheels as a group about said first-mentioned axis, relatively moving said plurality of grinding wheels and said workpiece back and forth in directions parallel to said workpiece surface, and simultaneously tilting said plurality of grinding wheels one way and then the other about an axis transverse to the direction of relative movement at each reversal of such relative movement so that they grind said workpiece surface with a negative rake.

2. A method of removing metal from the top generally horizontal surface of a workpiece such as a steel slab, bloom or billet comprising supporting a plurality of grinding wheels above said surface in a circular array about a generally vertical central axis and with the axes of said grinding wheels parallel to said central axis, forcing said grinding wheels individually down against said workpiece surface with a yielding pressure so that each grinding wheel can follow the contour of said surface independently of the others, rotating said grinding wheels about their own axes, orbiting said grinding wheels as a group about said central axis, relatively moving said plurality of grinding wheels and said workpiece horizontally back and forth in directions paralllel to said workpiece surface, and simultaneously tilting said plurality of grinding wheels away from the vertical one way and then the other about an axis at right angles to the direction of such relative movement at each reversal of such relative movement so that they grind said workpiece surface with a negative rake.

* * * * *